United States Patent [19]

Young

[11] Patent Number: 4,660,248

[45] Date of Patent: Apr. 28, 1987

[54] PICKUP TRUCK MOUNTED SWEEPER

[75] Inventor: Gary B. Young, Waco, Tex.

[73] Assignee: Tymco, Inc., Waco, Tex.

[21] Appl. No.: 649,671

[22] Filed: Sep. 12, 1984

[51] Int. Cl.[4] ..... E01H 1/08

[52] U.S. Cl. ..... 15/340; 15/346; 15/347; 15/352; 55/356; 55/459 A

[58] Field of Search ..... 15/340, 346, 347, 352; 55/356, 459 A

[56] References Cited

U.S. PATENT DOCUMENTS

| | | | |
|---|---|---|---|
| 2,887,714 | 5/1959 | Hanson | 15/340 |
| 3,512,206 | 5/1970 | Young | 15/340 X |
| 3,675,266 | 7/1972 | Murray et al. | 15/340 |
| 3,824,771 | 7/1974 | Williams | 15/340 X |
| 3,886,624 | 6/1975 | Landesman et al. | 15/340 |
| 4,062,085 | 12/1977 | Duncan | 15/340 X |
| 4,099,290 | 7/1978 | Hiszpanski | 15/346 X |
| 4,110,864 | 9/1978 | Gunnarson | 15/340 |
| 4,193,159 | 3/1980 | Beard | 15/346 X |
| 4,466,156 | 8/1984 | Blehert | 15/346 |

*Primary Examiner*—Chris K. Moore

*Attorney, Agent, or Firm*—Diller, Ramik & Wight

[57] ABSTRACT

This disclosure relates to a sweeper for roads, parking lots or like surfaces which is particularly adapted to be mounted upon a bed of a pickup truck, the sweeper including a hopper into which air-entrained debris is discharged, the hopper having a fore-aft axis to coincide with the direction of travel of an associated pickup truck, a pickup head, the pickup head being supported in transverse relationship to the fore-aft axis of the hopper, the hopper and pickup head each including an inlet and an outlet and conduits therebetween for conducting air-entrained debris from the pickup head into the hopper and conducting air from the hopper to the pickup head, and a centrifugal separator within the hopper having an axis disposed generally parallel to the hopper fore-aft axis.

32 Claims, 11 Drawing Figures

10
20
31
57
65
71
72
145
113
115
101
111
110
114
116
46
137
136
146
69
53
51
109
52
54
5
91
92
93
128
90
30
120
121
97
96
25
127
125
122
130
245
248
94
95
221
126
124
24
231
27
242
28
123
243
244
230
246
185
222
80
184
182
183
225
E
F
B
C2
T

FIG.7
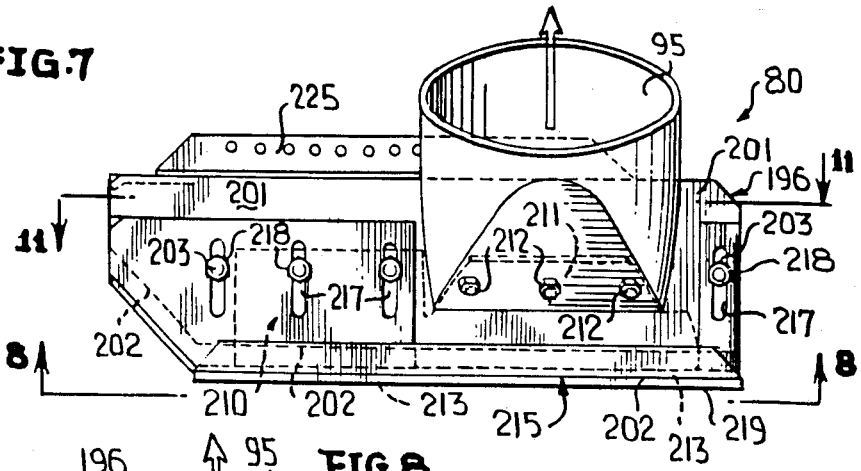
FIG.8
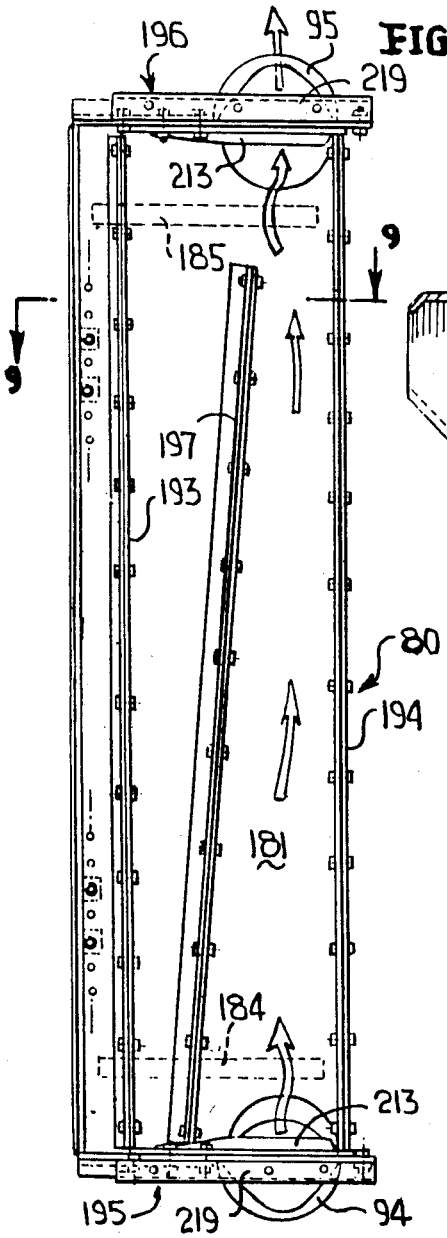
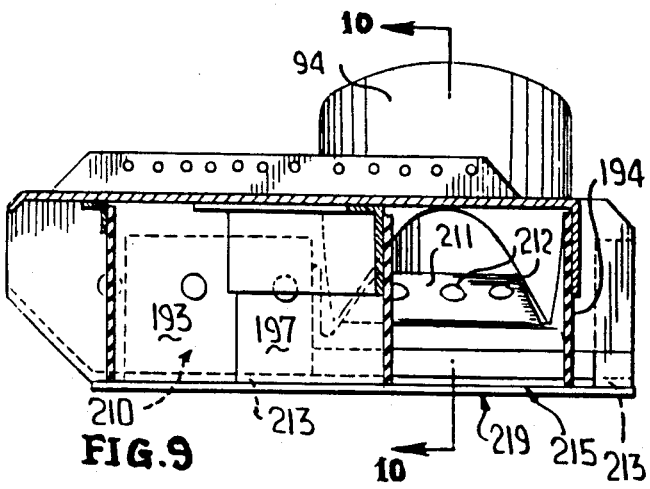
FIG.9
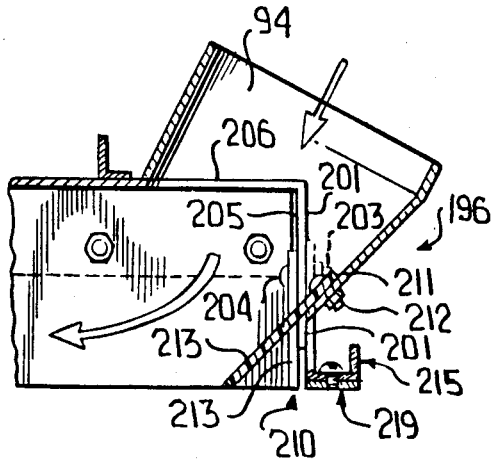
FIG.10

PICKUP TRUCK MOUNTED SWEEPER

Tymco, the assignee of the subject matter of this disclosure is the recognized leader and originator of REGENERATIVE AIR TM sweepers since the mid-1960's. Reference is made to U.S. Pat. Nos. 3,545,181; 3,512,206 and 3,790,981 for details of such REGENERATIVE AIR TM sweepers of Tymco which are relatively heavy-duty, high capacity models designed for cleaning airport runways, roadways, and other such relatively large expanses over which the sweeper is moved. While such REGENERATIVE AIR TM sweepers are highly efficient for sweeping large areas, the capital investement precludes the efficient use thereof for relatively small areas, such as small parking lots, parking areas at shopping malls, etc. Such lesser size surface areas dictate a minimum capital investment even though this reflects a proportionate reduction in overall hopper capacity. However, since a lesser surface area is being cleaned a reduction in hopper capacity is not detrimental but is actually economically desirable both from the initial capital investment (cost of the sweeper) and the day-to-day cost of operation, maintenance and the like.

In keeping with the foregoing, it is a primary object of the present invention to provide a novel REGENERATIVE AIR TM sweeper of relatively low-volume/capacity for sweeping relatively small parking lots, parking areas, roads or like surfaces and which is particularly adapted to be removably supported upon the bed of a pickup truck, the sweeper including a hopper into which debris is adapted to be discharged, the hopper having a fore-aft axis which coincides with the direction of travel of the pickup truck, a pickup head, the pickup head being supported in transverse relationship to the fore-aft axis of the hopper, the hopper and pickup head each including an inlet and an outlet, first and second conduits for conducting air-entrained debris from the pickup head to the hopper and from the hopper outlet to the pickup head inlet, respectively, means for generating a continuous recirculating stream of air along a closed path of travel including successively the pickup head, the pickup head outlet, the first conduit, the hopper inlet, the hopper outlet, the second conduit, and the pickup inlet, and means for centrifugally filtering the air stream during the travel thereof between the hopper inlet and the hopper outlet about an axis disposed generally parallel to the hopper fore-aft axis.

Still another object of this invention is to provide a novel sweeper as heretofore described including a removable screen between the hopper inlet and the centrifugal filtering means for separating debris from the air stream prior to the introduction of the air into the centrifugal separating means.

Still another object of the invention is to provide a novel sweeper wherein the means for generating the stream of air is a turbine, and the turbine has an axis which is generally coincident to an axis of the centrifugal filtering means.

Yet another object of this invention is to provide a novel filter of the type heretofore set forth wherein the hopper includes top and bottom walls, spaced side walls therebetween, and front and rear walls; the side walls having upper and lower side wall portions, the lower side wall portions being in generally upstanding relationship, one of the upper side wall portions being of a curved configuration and projecting laterally beyond its associated lower side wall portion, and the centrifugal filtering means is at least in part defined by the latter-noted curved upper side wall portion.

A further object of this invention is to provide a novel sweeper as latter defined wherein the centrifugal filtering means includes a generally cylindrical wall defining a centrifugal chamber, an air inlet at an uppermost portion of the cylindrical wall defined in part by the curved side wall portion through which the air stream enters from the hopper, and a debris outlet in the cylindrical wall at generally a lower portion thereof through which debris departs the centrifugal filtering means and enters the hopper.

Still another object of this invention is to provide a novel sweeper as aforesaid wherein the pickup head includes a top wall, front and rear walls and opposite side walls; the pickup head inlet and outlet being located one each at a removed portion of the intersection of an associated top and side wall, the first and second conduits having respective rigid first and second conduits secured to the pickup head at the outlet and inlet thereof, respectively, and the first and second rigid conduits each having an axis disposed at an angle of 60° to the horizontal.

With the above and other objects in view that will hereinafter appear, the nature of the invention will be more clearly understood by reference to the following detailed description, the appended claims and the several views illustrated in the accompanying drawings.

IN THE DRAWINGS

FIG. 1 is a rear perspective view of a REGENERATIVE AIR TM sweeper constructed in accordance with this invention, and illustrates the sweeper mounted upon a bed of an associated pick-up truck.

FIG. 2 is an enlarged cross-sectional view taken generally along line 2—2 of FIG. 1, and illustrates details of a hopper and a pickup head of the sweeper and associated conduits establishing a continuous recirculating air stream flowing into the hopper through a hopper inlet, through a debris-separating screen, into a centrifugal separator or filter whose axis is parallel to the fore-aft axis of the hopper, an outlet from a turbine through a conduit into the pickup head transversely spanning the pickup truck and another conduit leading back to the hopper.

FIG. 7 is a side elevational view of the pickup head, and illustrates a rigid conduit, a side wall seal and/or deflector and a vertically adjustable skid associated therewith.

FIG. 8 is a bottom plan view of the pickup head taken generally along line 8—8 of FIG. 7, and illustrates rigid conduits opening into a chamber of the pickup head through top and side walls thereof.

FIG. 9 is an enlarged cross-sectional view taken generally long line 9—9 of FIG. 8, and illustrates a partition panel within the pickup head chamber.

FIG. 10 is a cross-sectional view taken generally along line 10—10 of FIG. 9, and illustrates the manner in which the conduit opens into the pickup head chamber through an outlet opening in the top and end walls thereof.

Figure 1:
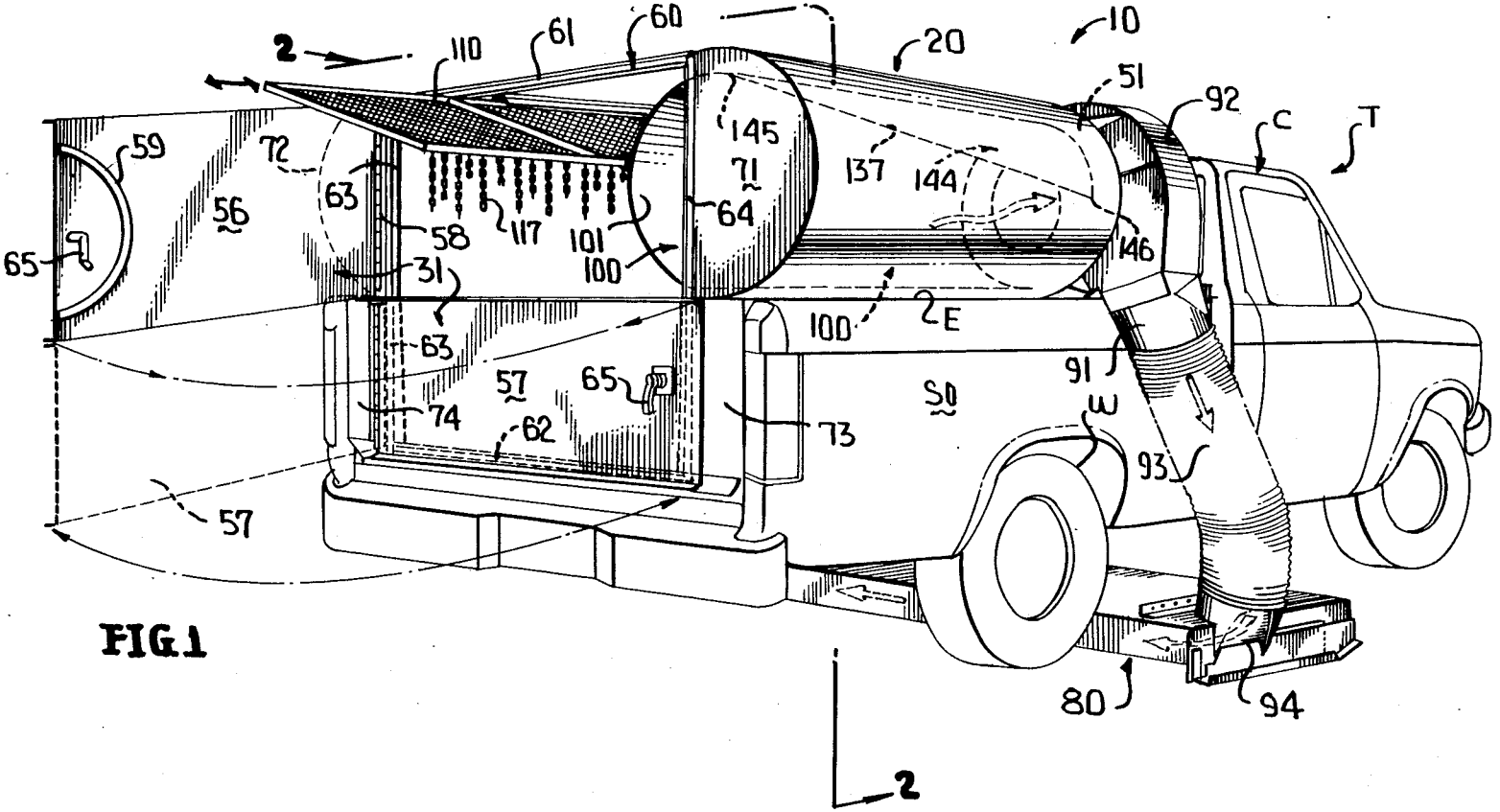
Figure 11:
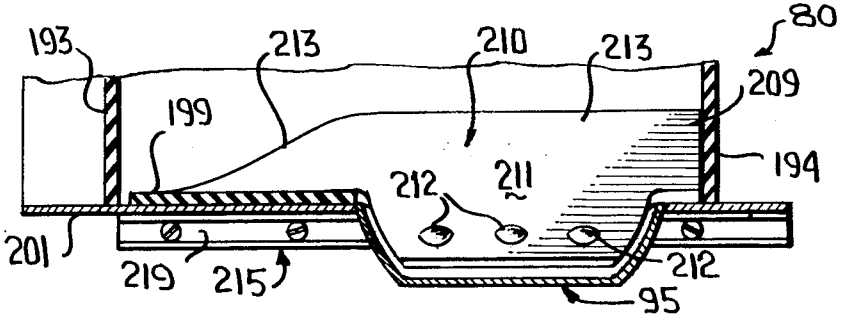

FIG. 11 which appears on the sheet of drawing containing FIG. 1 is a fragmentary cross-sectional view taken generally along line 11—11 of FIG. 7, and illustrates the bent or twisted configuration of the side wall deflector.

Figure 2:
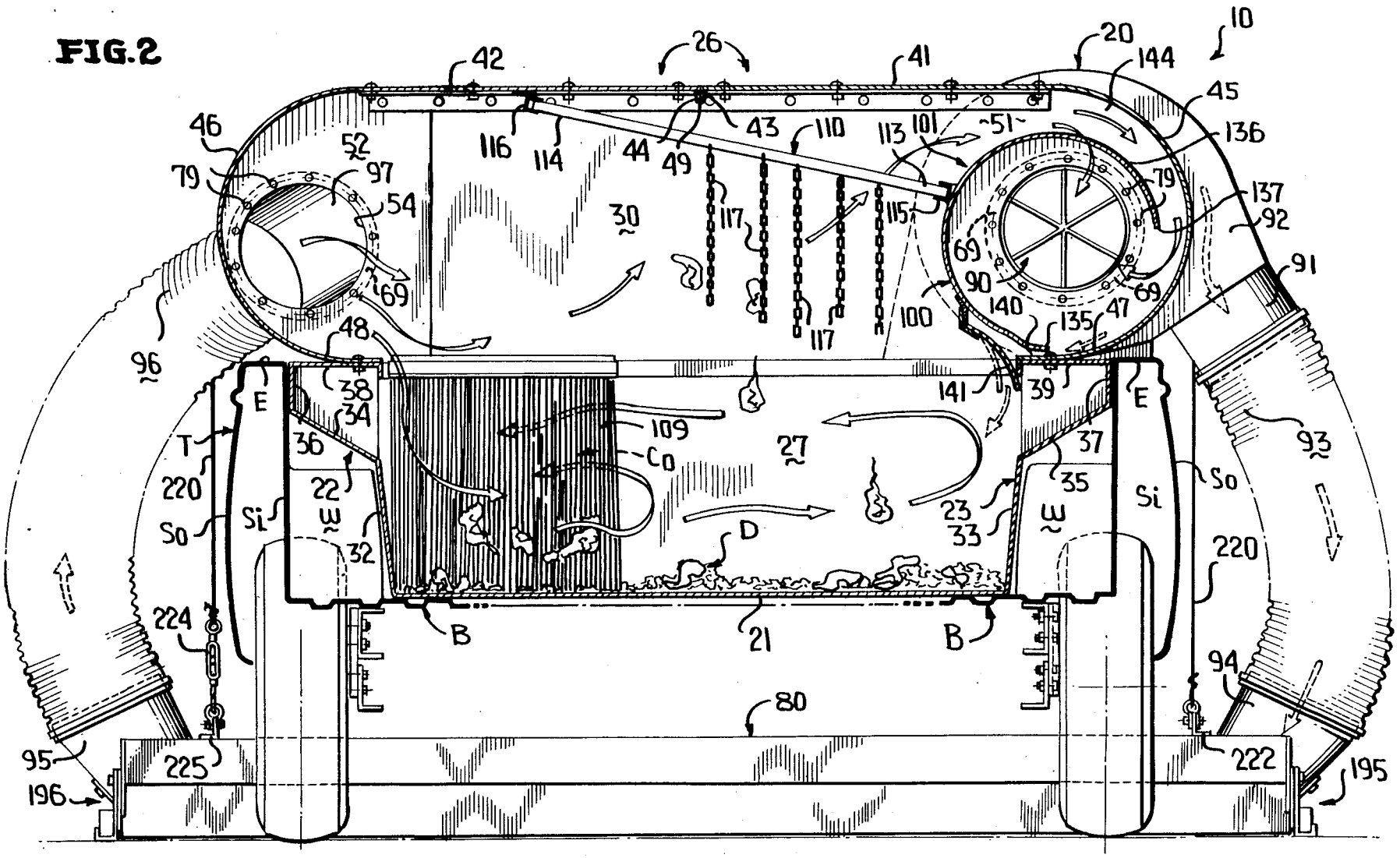

A novel REGENERATIVE AIR TM sweeper constructed in accordance with this invention is generally designated by the reference numeral 10 (FIGS. 1 through 4), and is illustrated mounted upon or within a bed B (FIG. 2) of a pickup truck T having a conventional cab C, outer side walls or panels So (FIGS. 1 and 2), upper longitudinal edges E thereof, inner side walls or panels Si, and wheel wells W (FIG. 2). Normally, the pickup truck T includes a tailgate, but the unillustrated tailgate has been removed incident to the positioning of the sweeper 10 upon the bed B. The pickup truck T can be most any 1967 or later American-made styleside pickup, as, for example, the Ford Ranger for light sweeping, the Ford F-150 for medium sweeping, and the Ford F-250 for heavy sweeping.

The sweeper 10 includes a hopper 20 defined by a bottom wall 21 (FIGS. 2 and 3) which rests upon the bed or floor B, side walls 22, 23, a forwardmost and lowermost top wall 24 (FIG. 3), an intermediate top wall 25, and an uppermost and rearmost top wall 26; a forwardmost front wall 27, an intermediate front wall 28, and a rearmost front wall 30; and a rear wall 31 (FIG. 1). The bottom wall 21 of the hopper 20 is of a generally rectangular configuration and is of a width and length so as to be accommodated within the bed B of the truck T, as is most evident from FIG. 2 of the drawings.

Figure 3:
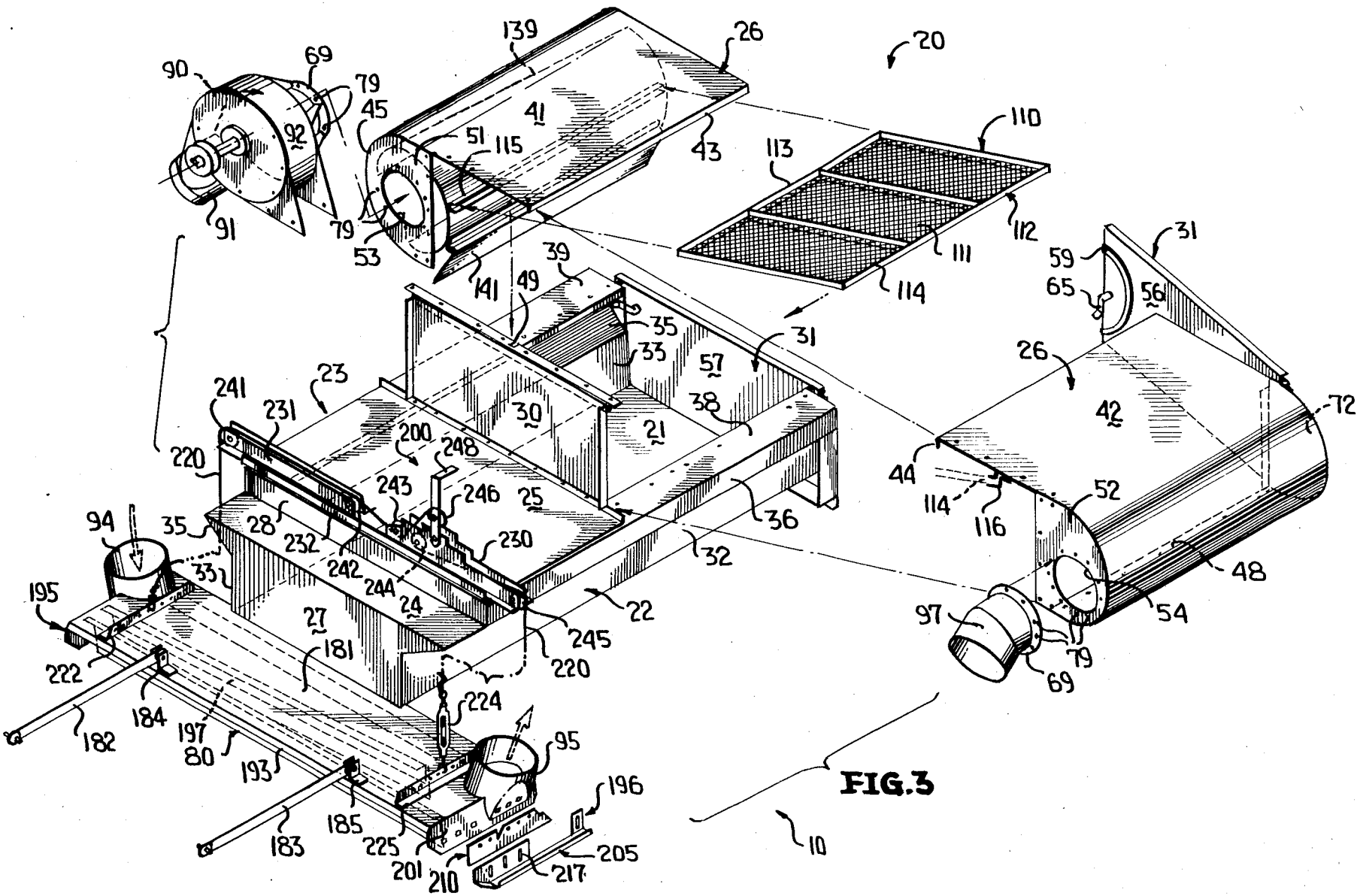
FIG. 3 is an exploded view of the sweeper of FIGS. 1 and 2, and illustrates several of the major components thereof, including a mechanism for raising and lowering the pickup head and details of the hopper construction.

The side walls 22, 23 are each identical, and each includes lower wall portions (unnumbered) defined by identical upwardly diverging walls or panels 32, 33 (FIG. 2), walls or panels 34, 35 which are in greater divergent relationship to each other than the walls 32, 33 (FIG. 2), generally parallel walls 36, 37 which are upright and normal to the bottom wall 21, and opposing inwardly directed walls 38, 39. Thus, the lower portion of the side wall 22 is defined by the walls 32, 34, 36 and 38 (FIG. 2), while the lower portion of the side wall 23 is defined by the walls 33, 35, 37, and 39. The walls 32, 34 and 33, 35 merge with and are welded or otherwise secured to the forwardmost front wall 27 (FIG. 3). However, the walls 36, 38 and 37, 39 terminate at the intermediate front wall 28 and are welded or are otherwise secured thereto and to the intermediate top wall 25.

The uppermost top wall 26 is formed of two generally identical top wall panels 41, 42, each having respective downwardly directed flanges 43, 44 which lie along the fore-aft center line plane of the hopper 20 and, of course, also of the pickup truck T and its bed B, as is most evident from FIG. 2 of the drawings. The flanges 43, 44 are secured to each other by appropriate bolts. Outboardmost portions 45, 46 of the respective top wall panels 41, 42 are each of a generally semi-cylindrical configuration and progressively curve outwardly, downwardly and inwardly terminating at inwardly opposing edge portions 47, 48, respectively (FIG. 2). The edge portions 47, 48 overlie and are bolted to the uppermost walls 39, 38, respectively, of the side walls 23, 22, respectively. Thus, part of the curved portions 45, 46 and the lower end portions 47, 48, respectively, thereof form continuations of the side walls 23, 22 and, of course, the upper portions of the wall portions 45, 46 also form portions of the top walls 41, 42. Thus, though there is no specific line of demarcation between the side walls 22, 23 and the top wall 26, at least a portion of each of the side walls 22, 23 is in part defined by lower portions of the curved wall portions or panels 46, 45, respectively. The same semi-cylindrical portions 45, 46 have a maximum outboard extent generally corresponding to that of the plane of the outer side panel So (FIG. 2) thereby optimizing the total space available between the side panels So for any particular pickup truck T with which the sweeper 10 is associated. Forwardmost edges (unnumbered) of the top wall panels 41, 42 are bolted to an uppermost edge (unnumbered) of the upstanding rearmost front wall 30, as is most evident from FIGS. 2 and 3 of the drawings. The flanges 43, 44 are not only secured to each other, but are also received in a notch 49 (FIGS. 2 and 3) formed in the flange of the front wall 30. Two other front walls or panels 51, 52 of somewhat greater than a semi-circular configuration are bolted to the top wall panels 41, 42, respectively, and to opposite lateral upstanding edges (unnumbered) of the front wall 30 and are generally coplanar therewith. The front walls or panels 51, 52 are provided with respective air outlet and air inlet openings 53, 54.

The rear wall 31 (FIG. 1) is defined by a pair of doors 56, 57 (FIG. 1), each mounted for pivotal opening along a vertical hinge or pivot 58. A seal or gasket 59 of a semi-circular configuration is carried by the door 56. The hinge 58 is secured along one side of a rigid rectangular rear frame 60 formed by an upper rail 61, a lower rail 62, a side rail 63, and another side rail 64. Handles 65 carried by each of the doors 56, 57 secure these doors closed in the manner clearly shown in FIG. 4. In addition to the doors 56, 57, the rear wall 31 of the hopper 20 is also defined by two generally semi-circular rear wall panels 71, 72 longitudinally opposite the panels 51, 52 and two generally rectangular rear wall panels 73, 74 which generally extend between the uppermost walls 39, 38, respectively, and the bottom wall 21 (FIG. 1).

One purpose of the hopper 20 of the sweeper 10 is, of course, to collect debris D (FIG. 2) conducted therein after having been picked up by a pickup head 80 (FIGS. 2 and 4) which will be described more fully hereinafter. However, with the pickup head 80 in its lowermost operative position (FIGS. 1 and 2) traversing the pickup truck T means in the form of a six bladed stainless steel rotating blade or turbine 90 generates a high pressure recirculating stream of air along a closed path of travel including successively the turbine or blower 90, an outlet 91 of a housing 92 of the turbine 90, conduit means 93 in the form of a flexible conduit, a rigid inlet conduit 94 opening into the pickup head 80, across the pickup head 80, a rigid outlet conduit or pipe 95 of the pickup head 80, second conduit means in the form of a flexible conduit 96, another rigid inlet conduit or pipe 97 bolted to the front wall portion 52, the inlet opening 54 of the latter, the interior of the hopper 20 generally along the top wall 26 thereof (FIG. 2) and back to the turbine 90 through means 100 for centrifugally separating, removing or filtering dust and relatively fine debris from the debris-entrained air stream prior to the introduction thereof once again and continuously into the turbine 90 through the opening 53.

The housing 92 includes a flange 69 (FIGS. 2, 3 and 4) which lies flush against and is bolted to the front wall or panel 51 by a plurality of bolts (not shown). The bolts pass through openings 79 formed in the flange 69 and in the periphery of the panel 51 adjacent the air inlet opening 53. There are six equally spaced openings 79 in the flange 69 of the housing 92 and twelve equally spaced openings 79 in the panel 51. Due to the latter relationship, the housing 92 can be rotated clockwise, as viewed in FIG. 2, from the position illustrated to another position approximately 20° to the right thereof which positions an outlet 91 of the housing 92 at a more downwardly directed vertical position than that shown in FIG. 2. Due to the latter adjustment, the same hopper 20 and housing 92 can be used on vehicles having narrower beds widthwise than the bed B illustrated as measured between the outer side panels So. Similarly, a like flange 69 associated with an inlet conduit 97 is also provided with similar openings 79, as is the front panel 52 to angularly adjust the conduit 97 for narrower vehicle beds.

Figure 4:
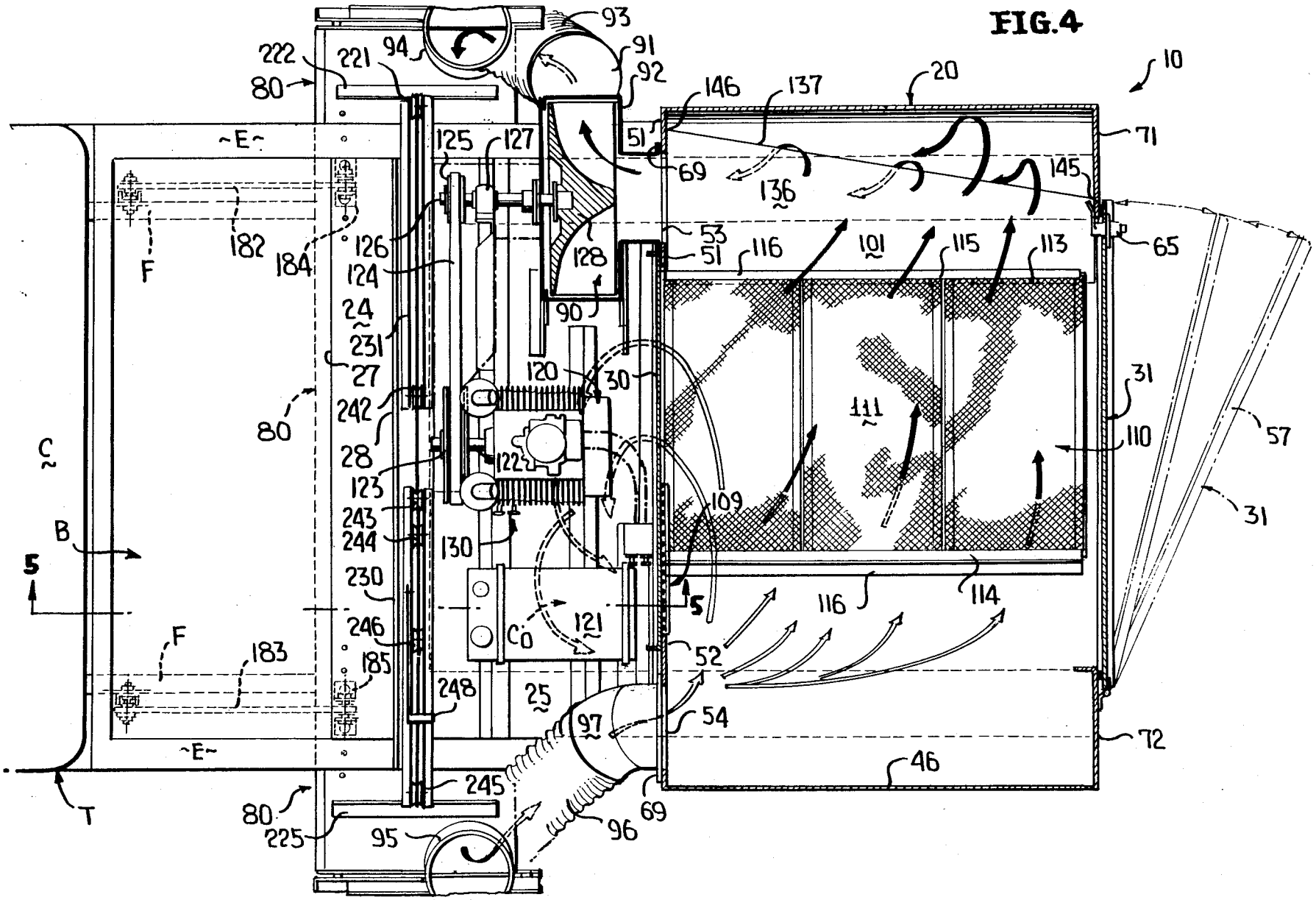
FIG. 4 is an enlarged fragmentary top plan view of the sweeper with a top wall of the hopper housing and the turbine housing removed for clarity, and illustrates the air flow by unnumbered headed arrows from the pickup head outlet into the hopper, through the screen, into and through the centrifugal separator, through the turbine housing and back to the pickup head.

During the movement of the debris-entrained air stream from the inlet 54 to the outlet 53 (FIG. 4), the heavier or larger pieces of debris D, such as large pieces of paper, cans, etc., tend simply to drop toward and accumulate upon the bottom wall 21. However, in order to prevent such heavier debris from being drawn into the centrifugal separator 100 means 110 (FIGS. 1 through 4) in the form of a generally rectangular screen are provided for separating heavier debris during the air flow along the top wall 26 of the hopper 20 between the inlet 54 and the centrifugal separating means 100. The screen or separating means 110 includes a screen 111 (FIGS. 3 and 4) of suitable mesh supported by a relatively rigid rectangular frame 112 having longitudinal frame members 113, 114. The distance between the frame members 113, 114 corresponds generally to the distance between a pair of channel members 115, 116 which generally extend the entire distance between the uppermost front wall 30 and the rear wall 31 (FIGS. 3 and 4). The channel member 115 is welded or otherwise secured to a generally semi-cylindrical wall 101 which extends between the semi-circular front wall portion 51 and the semi-circular rear wall portion 71 of the hopper 20. The channel member 116 is simply bolted or welded to the top wall panel 42 of the top wall 26, as is most evident from FIG. 2 of the drawings. The screen means or separating means 110 is thus inclined to the horizontal, as is best shown in FIG. 2, and as heavier or larger debris is drawn by the turbine 90 from the inlet 54 toward the outlet 53, it will contact the screen means 110 of specifically the screen 111 thereof and/or any of a number of chains 117 or like elongated elements suspended therefrom. The screen 110 and/or the chains 117 thereby prevent the heavier or larger debris from being drawn into the centrifugal separator 100, the outlet 53 and into the turbine 90 which might otherwise damage or adversely affect the air flow heretofore noted. Thus, the only debris which will enter the centrifugal separator 100 and/or the turbine 90 is debris of a size which will pass through the relatively small openings of the screen 111, and the latter openings are selected so as not to adversely affect the turbine 90 or the air flow created thereby. At any such time as the screen means 110 becomes undesirably clogged with debris, it can simply be slid partially or entirely outwardly of the hopper 20, as is generally indicated in FIG. 1, and can be cleaned and slid back to is operative position. The screen means 110 is essentially self-cleaning at any time that the turbine 90 is inoperative since any material lodged upon the underside of the screen 110 or the chains 117 will tend simply to drop thereform and accumulate upon the bottom wall 21. However, under prolonged usage of the sweeper 10, cleansing of the screen means or separator means 110 might be necessary and, thus, the channels 115, 116 facilitate such action by allowing the partial or total removal of the screen means or separating means 110 from the hopper 20 (FIG. 1).

Figure 5:
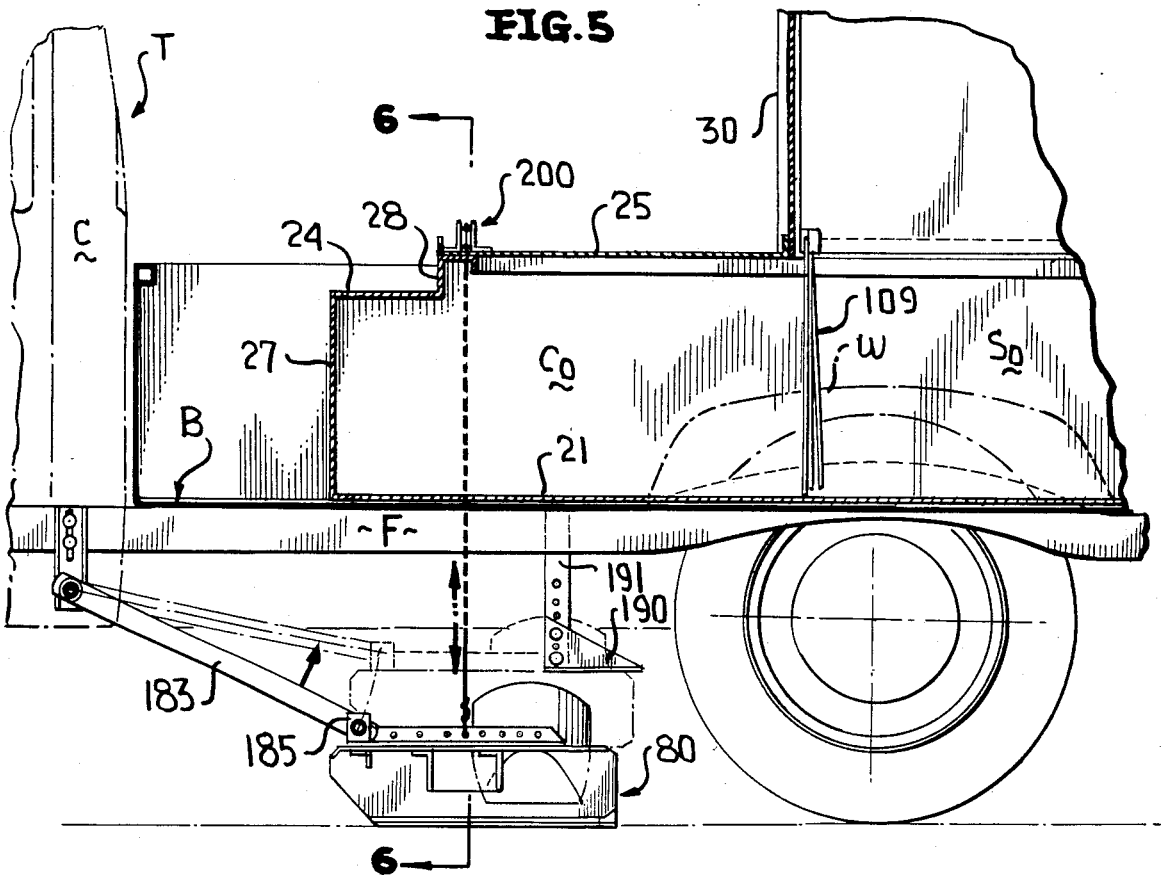
FIG. 5 is a fragmentary sectional view taken generally along line 5—5 of FIG. 4 with an auxiliary engine for the turbine and other components removed for clarity, and illustrates the manner in which the pickup head is mounted for pivoting movement transversly of the pickup truck between upper inoperative and lower operative positions.
Figure 6:
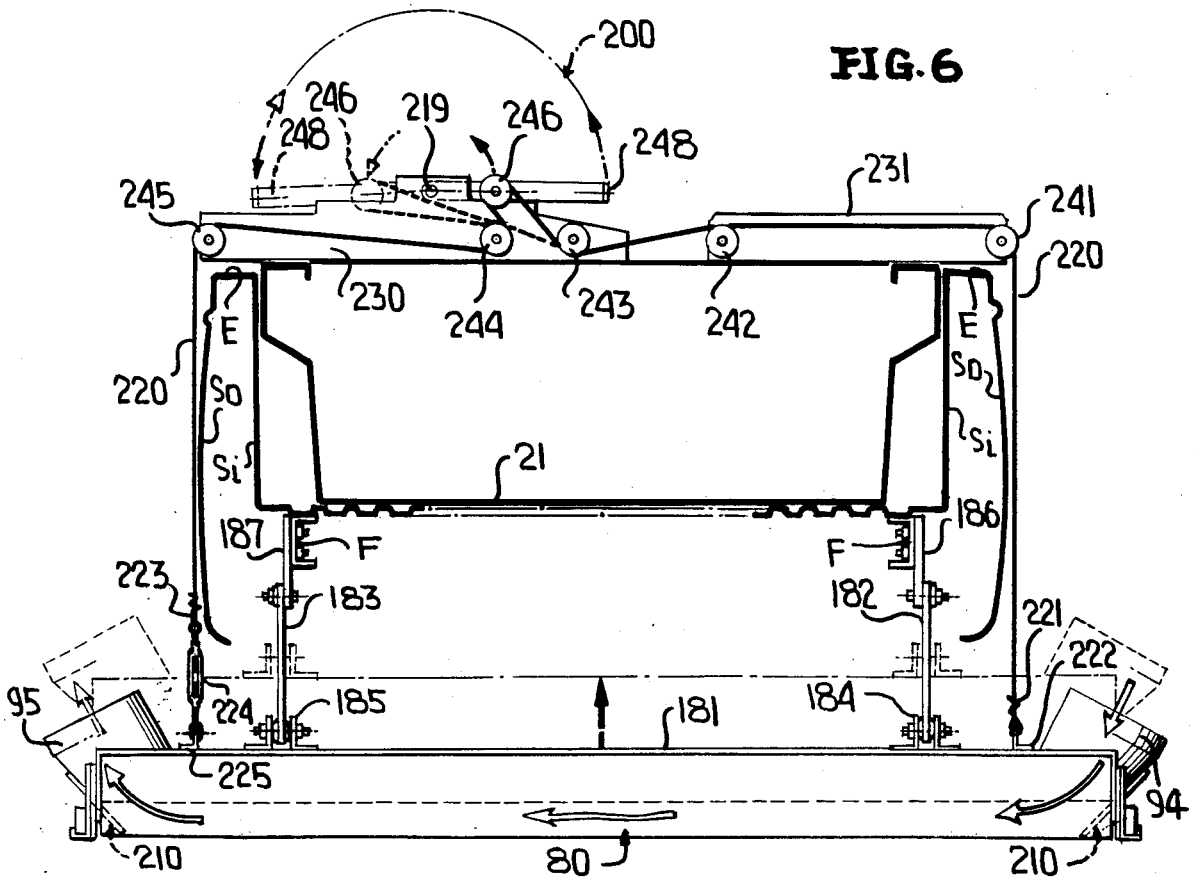
FIG. 6 is a cross-sectional view taken generally along line 6—6 of FIG. 5, and illustrates details of a mechanism for lifting and lowering the pickup head.

In addition to the screen means 110, a plurality of generally vertically disposed means 109 in the form of plastic reeds are secured along and generally depending from the wall 30 (FIGS. 2 and 5). The reeds 109 are disposed closely adjacent the wall portion 32 (FIG. 2) and extend therefrom toward but terminate short of the fore-aft longitudinal center line of the hopper 20. The reeds 109 thereby form an air-permeable screen and with the wall 27 (FIG. 5) and a portion of the wall portion 32 (FIG. 2) define a compartment or chamber Co into which a lower portion of the air stream flows in generally counterclockwise direction, as indicated by the unnumbered headed arrows so positioned in FIG. 4. This counterclockwise air flow or turbulence draws some of the debris D into the compartment or chamber Co through the open side (unnumbered) of the compartment Co which is to the right of the reeds 109 in FIG. 2. Once the debris is directed to the compartment Co, the reeds 109 prevent the same from being removed therefrom under the same counterclockwise air flow (FIG. 4). Thus, light or fine debris passes through the screen 111 and into the centrifugal filter 100, heavier debris generally falls to the bottom wall 21, and intermediate or moderate debris enters into the chamber Co and is entrapped therein by the reeds 109. In this fashion, effective air flow over extended use of the sweeper 10 is assured.

The turbine 90 is preferably driven by a conventional auxiliary gasoline or diesel engine 120 (FIG. 4) supplied with fuel from a tank 121 with both the engine 120 and a tank 121 being supported upon the top wall 25 in a conventional manner. The engine 120 includes an output shaft 122 carrying a pulley 123 about which is entrained a belt 124. The belt 124 is in turn entrained about a pulley 125 which is keyed to a shaft 126 of the turbine 90. The shaft 126 is suitably journaled for rotation in conventional bearings 127 and projects through an opening (not shown) of the turbine housing 92. The shaft 126 carries a turbine blade 128 and the axis of the shaft 126 is coincident to the outlet opening 53 of the hopper 20 (FIG. 4). A manual ignition switch and a manual throttle 130 (FIG. 4) is located adjacent the engine 120 at a point accessible from the driver's side of the pickup truck T. When it is desired to generate the air stream latter described, the throttle is opened, the ignition switch is closed, the engine 120 is thus started, and the throttle can then be adjusted to create whatever air blast and/or suction is desired for the particular sweeping purpose intended by appropriately driving the turbine blade 128.

Reference is now made to FIGS. 2 and 4 in particular which disclose the construction of the overall centrifugal filtering or separating means 100 which includes a generally cylindrical or toroidal housing defined by the generally semi-cylindrical curved wall portion 45 (FIG. 2) and the generally semi-cylindrical wall portion 101 which includes a lowermost edge 135 and an uppermost edge portion 136 having a free edge 137. The edge 135 is spaced from the wall portion 47 (FIG. 2) and defines therewith an outlet 140 through which dust or light debris can exit the interior of the centrifugal separator 100 past a rubber baffle or flap 141 which runs the length of the opening 140 between the wall panels 51, 71. The flap 141 is conventionally secured to the wall 101 and assures that the debris passing the opening or outlet 140 is directed immediately downwardly toward the bottom wall 21 so that it is not recaptured by the upper air stream adjacent the top wall 26 and recirculated through the centrifugal separator 100. Thus, the flap 141 in the open position (phantom outline in FIG. 2) assures that debris once separated will not be introduced into the air stream, but instead will be directed to the debris D upon the bottom wall 21 of the hopper 20.

The edge portion 136 defines with the wall portion 45 a progressively cicumferentially converging or tapering inlet opening 144 into which dust or debris-entrained air is drawn into the centrifugal separator 100 by the turbine 90. The inlet 144 not only tapers or converges circumferentially (FIG. 2), but the size of the opening 144 varies lengthwise of the walls 45, 101 because the edge 137 extends at an angle from a 12 o'clock position 145 (FIGS. 1, 2 and 4) adjacent the semicircular rear wall portion 71 to a 3 o'clock position 146 adjacent the semi-circular wall 51. By virtue of this configuration of the edge 137, the inlet 144 as defined between the wall portions 136, 45 is greater adjacent the generally semi-cylindrical wall panel 51 than adjacent the semi-circular rear wall portion 71. Stated another way, the overall size of the inlet 144 is greater adjacent the wall panel 71 than adjacent the wall panel 51 and this draws the air generally uniformly from the inlet opening 54 across and through the screen means 110 and into the centrifugal separator means 100, as is indicated by the unnumbered headed arrows associated therewith in FIG. 4. Thus, the debris-entrained air is uniformly drawn through the entirety of the screen 111 which results in a greater efficiency thereof in the absence of localized debris-blockage. Thus, the inlet 144 functions to create a generally uniform air flow into the centrifugal separator 100 over its entire axial length thus increasing the overall efficiency of not simply the separating means or screen means 110, but also the through-put or force of the air stream.

Reference is now made particularly to FIGS. 5 through 10 of the drawings in which the pickup head 80 is best illustrated and includes a top wall 181 carrying identical brackets 184, 185, each having a plurality of openings (unnumbered) for receiving pivot pins (also unnumbered) for securing suspension links 182, 183, respectively, thereto. The links 182, 183 are in turn pivotally connected by pivot pins (unnumbered) to brackets 186, 187 which are in turn connected to frame members F of the pickup truck T. The links 182, 183 permit the pickup head 80 to be moved between the operative solid outline position (FIG. 5) and the inoperative phantom outline position through a suitable mechanism 200 (FIGS. 4, 5 and 6) which will be described more fully hereinafter. In the uppermost inoperative position (phantom outline, FIG. 5) the top wall 181 of the pickup head 80 abuts against the underside of a generally triangular abutment bracket 190 adjustably supported along a vertical channel iron 191 bolted to each of the frame members F. Only one of the abutment brackets 190 and its associated channel iron 191 is shown in FIG. 5, but there are two such brackets and channel irons, one associated with each frame member F. The abutment brackets 190 afford stability to the pickup head in its inoperative uppermost position during travel of the truck T.

The pickup head 80 further includes a front wall 193, a rear wall 194, identical side walls 195, 196 and an intermediate partition wall 197 (FIG. 8) positioned between the walls 193, 194. The partition wall 196 and the rear wall 194 define a converging path of travel for the air stream from the inlet conduit 94 toward the outlet conduit 95, as is indicated by the unnumbered headed arrows in FIG. 8. The walls 193, 194 and 197 have lowermost edges (unnumbered) which are normally elevated above the ground surface and projecting below these edges are a plurality of seals (unnumbered) of the type shown in Young U.S. Pat. Nos. 3,512,206 and 3,545,181. These seals deflect to permit material/debris to enter into the pickup head 80, and specifically between the walls 194, 197, to be blown therealong by the high velocity air stream to and through the rigid conduit 95 and subsequently into the hopper 20 over the flow path heretofore defined.

The side walls 195, 196 differ, however, from those disclosed in the latter-noted Young patents and reference is particularly made to FIGS. 7, 9 and 10 wherein like reference numerals have been applied to the side walls 195, 196 to identify identical structure thereof. Each of the side walls 195, 196 includes a side plate 201 welded to the top plate 181 and to the ends of the front and rear walls 193, 194, respectively. The side plate 201 has a lower edge 202 and a plurality of openings (unnumbered) through which project bolts 203 having heads 204. Each side plate 201 also includes an opening 205 which in conjunction with an opening 206 (FIG. 10) of the top wall 181 define an inlet/outlet of the pickup head 80 adjacent the respective conduits 94, 95. Thus, each outlet 205, 206 is essentially defined by metal removed at the corners of each of the side plates 201 and the associated top wall 181. It is at these outlets 205, 206 that the rigid conduits 94, 95 are welded at an angle of approximately 60° to the horizontal (FIG. 10) which provides a smooth transition for the air flow downwardly into the pickup head 80 through the conduit 94 and outwardly of the pickup head 80 through the conduit 95.

The five bolts 203 pass through openings (not shown) in a side plate seal or deflector 210 formed of a elastomeric material which is positioned along the inside surface of each of the side plates 201. Each deflector 210 includes a front portion 199 (FIG. 11), a rear portion 209 and a tongue portion or tongue 211 therebetween. A forwardmost edge (unnumbered) of the front portion 199 is disposed in a vertical plane, as is an upper portion (unnumbered) of the front portion 199 above the bolts 203 (FIG. 7). However, the tongue portion 211 (FIGS. 9 through 11) is bent into an associated conduit 94, 95 and is fastened thereto by three nuts and bolts collectively identified by the reference numeral 212. Because of the latter bend or twist and the nuts and bolts 212 holding the tongue portion 211 against the inclined surface (unnumbered) of the conduits 94, 95, a lower edge 213 of each deflector 210 is progressively twisted or bent from a vertical plane into the plane of the tongue portion 211 and the rear portion 209 which define an angle of approximately 45° to the horizontal. The purpose of the twist in each deflector or seal 210 is to provide a gradual transition for relatively large debris, such as rocks, bottles, soda cans, beer cans or the like, particularly at the outlet conduit 95. Such heavier debris will be blown against and/or contact the lower portion 213 anywhere along and between the front and rear portions 199, 209, respectively, and will be progressively and gradually guided upwardly toward and along the tongue portion 211 and into the conduit 95 for subsequent discharge. Thus, the twisted or bent deflectors 210 effect a gradual transition of heavier debris from the generally horizontal surface being swept through the 45° transition and beyond to the generally vertical for subsequent introduction into the hopper 20. In the absence of the twisted or bent construction of the deflector 210, such large debris would simply lodge against the associated side plates 201 and/or eventually escape beyond the rear wall 194 of the pickup head 80.

The lower edge 213 of the side seal or deflector 210 is also closely adjacent the surface being swept. Thus, air being blown along the walls 194, 197 (FIG. 8) toward the seal 210 at the conduit 95 is directed from a generally horizontal plane smoothly through the 45° transition and outwardly of the conduit 95. Thus, while the twisted portion of the deflector 210 creates a gradual transition for large debris, the deflector 210 also "seals" the escape of air endwise beyond the side walls 195, 196 to assure minimum air loss and to maintain maximum air flow.

In order to assure that the lower edges 213 and the side seals or deflectors 210 are positioned as desired relative to the surface being swept, each of the side walls 195, 196 is provided with a skid or skid plate 215 having a rolled lower edge (unnumbered) to which is bolted a skid bar 209 of wear-resistant material. The skid bar 209 engages and rides along the surface being swept when the pickup head 80 is in its lowermost position. Each skid 215 has a plurality of vertical slots 217 receiving the bolts 203. Nuts 218 are applied to the bolts 203 and tightened to maintain the skid 215 in any desired position of vertical adjustment to thereby locate the edge 213 of the side plate seals or deflectors 210 as desired.

The mechanism 200 for moving the pickup head 80 between the operative and inoperative positions (FIGS. 5 and 6) includes a cable 220 having one end 221 connected to one of a plurality of openings in a bracket 222 welded to the top wall 181 of the pick-up head 80. An opposite end 223 of the cable 220 is connected to a turnbuckle 224 which is in turn connected to one of a plurality of openings in another bracket 225 welded to the top plate 181 of the pickup head 80.

A pair of brackets 230, 231 (FIGS. 3, 5 and 6) are supported in a track 232 (FIG. 3) which is in turn bolted to the top wall 25 of the hopper 20. The brackets 230, 231 can be slid in the track or channel 232 toward or away from each other and locked in any position by appropriate nuts and bolts (not shown) to accommodate vehicles which have beds B of different widths. The bracket 231 carries guide rollers 241, 242, while the bracket 230 carries guide rollers 243 through 245. An arm 248 is pivoted at 249 to the bracket 230 and carries a guide roller 246. The cable 220 is entrained about the rollers 241 through 246 in the manner clearly illustrated in FIG. 6. When the handle 248 is in the solid outline position or to the right in FIG. 6, the pickup head 80 is in its lowermost position. However, if the handle 248 is pivoted from the solid outline position in FIG. 6 toward the phantom outline position in this same figure, the roller 246 is moved about an arc defined by the pivot 249 and eventually reaches the phantom outline position in FIG. 6 during which movement the cable 220 is retracted to lift the pickup head 80 to its inoperative or uppermost position. Obviously, the handle 248 can be locked in either of the two positions shown in FIG. 6 in a conventional manner.

OPERATION

When it is desired to sweep a surface, an operator merely starts the engine 120 through the controls 130, including the associated starter switch, starter motor and throttle, at which point the blower turbine 90 creates the air stream heretofore defined and indicated by the unnumbered headed arrows in FIGS. 2 and 4. The operator then grasps the handle 248 and moves the same from the phantom outline position (FIG. 6) to the solid position (shown in the same figure) to lower the pickup head 80 to a position determined by the engagement of the skids 215 at each of the side walls 195, 196 with the surface which is to be swept. The screen means 110 is, of course, totally within the hopper 20 and the doors 56, 57 are closed. The seal 59 on the door 56 closes the rearmost end of the centrifugal separator 100, as was heretofore described. The air stream is thus established over the flow path heretofore described and, once again, is indicated by unnumbered headed arrows in FIGS. 2 and 4, after which the operator merely proceeds to drive the truck T along the surface which is to be swept. The debris which enters the pickup head 80 is blown by the air stream shown in FIG. 8 into the outlet conduit 95, into the flexible conduit 96 (FIG. 2) and, thence, into the hopper 20. The heavier debris D simply drops to the bottom wall 21 of the hopper 20. The debris which is separated or entrained by the screen means 110 and/or the chains 117 associated therewith also tends to drop to the bottom wall 21. The dust-entrained or lighter debris-entrained air then enters the centrifugal filtering means or separator 100 through the inlet 144 thereof. The circulation of the dust-entrained air results in the centrifugal separation of the dust and light debris which exits through the opening 140 heretofore noted with the cleaner air then simply recirculating back to the pickup head 80 through the housing 92, the conduit 91, the flexible conduit 93 and the rigid inlet conduit 94. It will be particularly noted from FIG. 2 that the 60° axial inclination of the conduits 94, 95 create a relatively smooth transition zone for the entry and exit of the air stream relative to the pickup head 80 via the conduits 93, 96, respectively. In this fashion, the relatively simple but economical construction of the sweeper 10 permits it to be readily accommodated upon a smaller and less expensive pickup truck T with attendant high efficiency performance and low initial capital expenditure and continuing maintenance cost.

Although in a preferred embodiment of the invention as has been specifically illustrated and described herein, it is to be understood that minor variations may be made in the apparatus without departing from the spirit and scope of the invention, as defined in the appended claims.

What is claimed is:

1. A sweeper for roads, parking lots or like surfaces which is particularly adapted to be mounted upon a bed of a mobile vehicle comprising means for defining a hopper into which debris is adapted to be discharged, said hopper having spaced front and rear walls and a pair of spaced side walls each having upper and lower side wall portions, a fore-aft axis disposed generally in transverse relationship to said front and rear walls to thereby coincide with the direction of travel of said associated mobile vehicle, a pick-up head, means for supporting said pick-up head from said associated mobile vehicle in transverse relationship to the fore-aft axis of said hopper, said hopper and pick-up head each including an inlet and an outlet, first conduit means between said pick-up head outlet and said hopper inlet for conducting air-entrained debris from said pick-up head into said hopper, second conduit means between said hopper outlet and said pick-up head inlet for conducting air from said hopper to said pick-up head, means for generating a continuous recirculating stream of air along a closed path of travel including successively said pick-up head, said pick-up head outlet, said first conduit means, said hopper inlet, said hopper, said hopper outlet, said second conduit means, and said pick-up head inlet, means for centrifugally removing debris from the air stream during the travel thereof between said hopper inlet and said hopper outlet about an axis disposed generally parallel to said hopper fore-aft axis, said hopper including a longitudinal center line between said side walls and generally parallel to said fore-aft axis, said centrifugal removing means being disposed adjacent one of said side walls and remote from the other of said side walls, the axis of said centrifugal removing means being in transversely spaced relationship to said hopper longitudinal center line, said hopper inlet and hopper outlet being on opposite sides of said hopper longitudinal centerline adjacent respective ones of said side walls, and said inlet being on the side of said centerline opposite said centrifugal removing means to enhance separation from the airstream of larger particles of debris.

2. The sweeper as defined in claim 1 including means between said hopper inlet and said centrifugal removing means for separating debris from the air stream.

3. The sweeper as defined in claim 2 wherein said air stream generating means includes a rotating blade, and said rotating blade has an axis which is generally coincident to an axis of said centrifugal removing means.

4. The sweeper as defined in claim 2 wherein said centrifugal removing means includes a generally cylindrical wall defining a centrifugal chamber, an air inlet in said cylindrical wall through which the air stream enters from the hopper, an air outlet for conducting the air stream from said centrifugal chamber to said air stream generating means, and a debris outlet in said cylindrical wall through which debris centrifugally removed from the air stream enters into said hopper.

5. The sweeper as defined in claim 1 wherein said air stream generating means includes a rotating blade.

6. The sweeper as defined in claim 1 wherein said air stream generating means at least in part defined by a rotating blade.

7. The sweeper as defined in claim 6 wherein said centrifugal removing means includes a generally cylindrical wall defining a centrifugal chamber, an air inlet in said cylindrical wall through which the air stream enters from the hopper, an air outlet for conducting the air stream from said centrifugal chamber to said air stream generating means, and a debris outlet in said cylindrical wall through which debris centrifugally removed from the air stream enters into said hopper.

8. The sweeper as defined in claim 6 including means between said hopper inlet and said centrifugal removing means for separating debris from the air stream, and means for allowing removal of said separating means at least partially from said hopper.

9. The sweeper as defined in claim 6 including screen means between said hopper inlet and said centrifugal removing means and in the path of said air stream for separating debris therefrom prior to the air entering said centrifugal removing means.

10. The sweeper as defined in claim 6 including screen means between said hopper inlet and said centrifugal removing means and in the path of said air stream for separating debris therefrom prior to the air entering said centrifugal removing means, and means for removing said screen means at least partially from said hopper.

11. The sweeper as defined in claim 1 wherein said air stream generating means includes a rotating blade, and said rotating blade has an axis which is generally coincident to said axis of said centrifugal removing means.

12. The sweeper as defined in claim 11 wherein said centrifugal removing means includes a generally cylindrical wall defining a centrifugal chamber, an air inlet in said cylindrical wall through which the air stream enters from the hopper, an air outlet for conducting the air stream from said centrifugal chamber to said air stream generating means, and a debris outlet in said cylindrical wall through which debris centrifugally removed from the air stream enters into said hopper.

13. The sweeper as defined in claim 11 including means between said hopper inlet and said centrifugal removing means for separating debris from the air stream, and means for allowing removal of said separating means at least partially from said hopper.

14. The sweeper as defined in claim 11 including screen means between said hopper inlet and said centrifugal removing means and in the path of said air stream for separating debris therefrom prior to the air entering said centrifugal removing means.

15. The sweeper as defined in claim 11 including screen means between said hopper inlet and said centrifugal removing means and in the path of said air stream for separating debris therefrom prior to the air entering said centrifugal removing means, and means for allowing removal of said screen means at least partially from said hopper.

16. The sweeper as defined in claim 1 wherein said hopper inlet and outlet have parallel axes.

17. The sweeper as defined in claim 1 including means for moving said pick-up head between upper inoperative and lower operative positions, and means for stabilizing said pick-up head in said upper inoperative position.

18. The sweeper as defined in claim 1 wherein said hopper includes top and bottom walls; and said rear wall includes a pair of doors.

19. The sweeper as defined in claim 1 wherein said hopper includes top and bottom walls; said rear wall includes a pair of doors, and means for pivoting at least one of said doors about a generally vertical axis.

20. The sweeper as defined in claim 1 including an internal combustion engine having an output drive shaft, means for connecting said output drive shaft to said air stream generating means, means for throttling said internal combustion engine, and means adjacent said throttling means for moving said pick-up head between upper inoperative and lower operative positions.

21. A sweeper for roads, parking lots or like surfaces which is particularly adapted to be mounted upon a bed of a mobile vehicle comprising means for defining a hopper into which debris is adapted to be discharged, said hopper having a fore-aft axis to coincide to the direction of travel of said associated mobile vehicle, a pick-up head, means for supporting said pick-up head from said associated mobile vehicle in transverse relationship to the fore-aft axis of said hopper, said hopper and pick-up head each including an inlet and an outlet, first conduit means between said pick-up head outlet and said hopper inlet for conducting air-entrained debris from said pick-up head into said hopper, second conduit means between said hopper outlet and said pick-up head inlet for conducting air from said hopper to said pick-up head, means for generating a continuous recirculating stream of air along a closed path of travel including successively said pick-up head, said pick-up head outlet, said first conduit means, said hopper inlet, said hopper, said hopper outlet, said second conduit means, and said pick-up head inlet, means for centrifugally removing debris from the air stream during the travel thereof between said hopper inlet and said hopper outlet about an axis disposed generally parallel to said hopper fore-aft axis, said hopper being defined at least in part by a pair of side walls having upper and lower side wall portions, said lower side wall portions being in generally upstanding relationship, one of said upper side wall portions being of a curved configuration and projecting laterally beyond its associated lower side wall portion, and said centrifugal removing means being at least in part defined by said curved upper side wall portion.

22. The sweeper as defined in claim 1 wherein said centrifugal removing means includes a generally cylindrical wall defining a centrifugal chamber, an air inlet in said cylindrical wall through which the air stream enters from the hopper, an air outlet for conducting the air stream from said centrifugal chamber to said air stream generating means, and a debris outlet in said cylindrical wall through which debris centrifugally removed from the air stream enters into said hopper.

23. The sweeper as defined in claim 1 including means between said hopper inlet and said centrifugal removing means for separating debris from the air stream, and means for allowing removal of said separating means at least partially from said hopper.

24. The sweeper as defined in claim 1 including screen means between said hopper inlet and said centrifugal removing means and in the path of said air stream for separating debris therefrom prior to the air entering said centrifugal removing means.

25. The sweeper as defined in claim 1 including screen means between said hopper inlet and said centrifugal removing means and in the path of said air stream for separating debris therefrom prior to the air entering said centrifugal removing means, and means for removing said screen means at least partially from said hopper.

26. The sweeper as defined in claim 1 wherein said pick-up head includes a top wall, front and rear walls and opposite side walls; said pick-up head inlet and outlet being located one each at a removed portion of the intersection of an associated top and side wall, said first and second conduits having respective rigid first and second conduits secured to said pick-up head at the outlet and inlet thereof respectively, and said first and second rigid conduits each having an axis disposed at an angle of generally 60 degrees to the horizontal.

27. The sweeper as defined in claim 1 wherein said pick-up head includes a top wall, front and rear walls and opposite side walls, a side plate disposed in generally face-to-face relationship with each side wall, and means for vertically selectively adjusting each side plate relative to its assocaited side wall.

28. A sweeper for roads, parking lots or like surfaces which is particularly adapted to be mounted upon a bed of a mobile vehicle comprising means for defining a hopper into which debris is adapted to be discharged, said hopper having a fore-aft axis to coincide to the direction of travel of said associated mobile vehicle, a pick-up head, means for supporting said pick-up head from said associated mobile vehicle in transverse relationship to the fore-aft axis of said hopper, said hopper and pick-up head each including an inlet and an outlet, first conduit means between said pick-up head outlet and said hopper inlet for conducting air-entrained debris from said pick-up head into said hopper, second conduit means between said hopper outlet and said pick-up head inlet for conducting air from said hopper to said pick-up head, means for generating a continuous recirculating stream of air along a closed path of travel including successively said pick-up head, said pick-up head outlet, said first conduit means, said hopper inlet, said hopper, said hopper outlet, said second conduit means, and said pick-up head inlet, means for centrifugally removing debris from the air stream during the travel thereof between said hopper inlet and said hopper outlet about an axis disposed generally parallel to said hopper fore-aft axis, means between said hopper inlet and said centrifugal removing means for separating debris from the air stream, said hopper being defined at least in part by a pair of side walls having upper and lower side wall portions, said lower side wall portions being in generally upstanding relationship, one of said upper side wall portions being of a curved configuration and projecting laterally beyond its associated lower side wall portion, and said centrifugal removing means being at least in part defined by said curved upper side wall portion.

29. A sweeper for roads, parking lots or like surfaces which is particularly adapted to be mounted upon a bed of a mobile vehicle comprising means for defining a hopper into which debris is adapted to be discharged, said hopper having a fore-aft axis to coincide to the direction of travel of said associated mobile vehicle, a pick-up head, means for supporting said pick-up head from said associated mobile vehicle in transverse relationship to the fore-aft axis of said hopper, said hopper and pick-up head each including an inlet and an outlet, first conduit means between said pick-up head outlet and said hopper inlet for conducting air-entrained debris from said pick-up head into said hopper, second conduit means between said hopper outlet and said pick-up head inlet for conducting air from said hopper to said pick-up head, means for generating a continuous recirculating stream of air along a closed path of travel including successively said pick-up head, said pick-up head outlet, said first conduit means, said hopper inlet, said hopper, said hopper outlet, said second conduit means, and said pick-up head inlet, means for centrifugally removing debris from the air stream during the travel thereof between said hopper inlet and said hopper outlet about an axis disposed generally parallel to said hopper fore-aft axis, said air stream generating means being at least in part defined by a rotary blade, said hopper being defined at least in part by a pair of side walls having upper and lower side wall portions, said lower side wall portions being in generally upstanding relationship, one of said upper side wall portions being of a curved configuration and projecting laterally beyond its associated lower side wall portion, and said centrifugal removing means being at least in part defined by said curved upper side wall portion.

30. A sweeper for roads, parking lots or like surfaces which is particularly adapted to be mounted upon a bed of a mobile vehicle comprising means for defining a hopper into which debris is adapted to be discharged, said hopper having a fore-aft axis to coincide to the direction of travel of said associated mobile vehicle, a pick-up head, means for supporting said pick-up head from said associated mobile vehicle in transverse relationship to the fore-aft axis of said hopper, said hopper and pick-up head each including an inlet and an outlet, first conduit means between said pick-up head outlet and said hopper inlet for conducting air-entrained debris from said pick-up head into said hopper, second conduit means between said hopper outlet and said pick-up head inlet for conducting air from said hopper to said pick-up head, means for generating a continuous recirculating stream of air along a closed path of travel including successively said pick-up head, said pick-up head outlet, said first conduit means, said hopper inlet, said hopper, said hopper outlet, said second conduit means, and said pick-up head inlet, means for centrifugally removing debris from the air stream during the travel thereof between said hopper inlet and said hopper outlet about an axis disposed generally parallel to said hopper fore-aft axis, said air stream generating means includes a rotary blade, said rotating blade having an axis which is generally coincident to said axis of said centrifugal removing means, said hopper being defined at least in part by a pair of side walls having upper and lower side wall portions, said lower side wall portions being in generally upstanding relationship, one of said upper side wall portions being of a curved configuration and projecting laterally beyond its associated lower side wall portion, and said centrifugal removing means being at least in part defined by said curved upper side wall portion.

31. A sweeper for roads, parking lots or like surfaces which is particularly adapted to be mounted upon a bed of a mobile vehicle comprising means for defining a hopper into which debris is adapted to be discharged, said hopper having a fore-aft axis to coincide to the direction of travel of said associated mobile vehicle, a pick-up head, means for supporting said pick-up head from said associated mobile vehicle in transverse relationship to the fore-aft axis of said hopper, said hopper and pick-up head each including an inlet and an outlet, first conduit means between said pick-up head outlet and said hopper inlet for conducting air-entrained debris from said pick-up head into said hopper, second conduit means between said hopper outlet and said pick-up head inlet for conducting air from said hopper to said pick-up head, means for generating a continuous recirculating stream of air along a closed path of travel including successively said pick-up head, said pick-up head outlet, said first conduit means, said hopper inlet, said hopper, said hopper outlet, said second conduit means, and said pick-up head inlet, means for centrifugally removing debris from the air stream during the travel thereof between said hopper inlet and said hopper outlet about an axis disposed generally parallel to said hopper fore-aft axis, said hopper being defined at least in part by a pair of side walls having upper and lower side wall portions, said lower side wall portions being in generally upstanding relationship, at least one of said upper side wall portions being of a curved configuration, and said centrifugal removing means being at least in part defined by said curved upper side wall portion.

32. A sweeper for roads, parking lots or like surfaces which is particularly adapted to be mounted upon a bed of a mobile vehicle comprising means for defining a hopper into which debris is adapted to be discharged, said hopper having a fore-aft axis to coincide to the direction of travel of said associated mobile vehicle, a pick-up head, means for supporting said pick-up head from said associated mobile vehicle in transverse relationship to the fore-aft axis of said hopper, said hopper and pick-up head each including an inlet and an outlet, first conduit means between said pick-up head outlet and said hopper inlet for conducting air-entrained debris from said pick-up head into said hopper, second conduit means between said hopper outlet and said pick-up head inlet for conducting air from said hopper to said pick-up head, means for generating a continuous recirculating stream of air along a closed path of travel including successively said pick-up head, said pick-up head outlet, said first conduit means, said hopper inlet, said hopper, said hopper outlet, said second conduit means, and said pick-up head inlet, means for centrifugally removing debris from the air stream during the travel thereof between said hopper inlet and said hopper outlet about an axis disposed generally parallel to said hopper fore-aft axis, means between said hopper inlet and said centrifugal removing means for separating debris from the air stream, said hopper being defined at least in part by a pair of side walls having upper and lower side wall portions, said lower side wall portions being in generally upstanding relationship, at least one of said upper side wall portions being of a curved configuration, and said centrifugal removing means being at least in part defined by said curved upper side wall portion.

* * * * *